United States Patent [19]

Preston, Jr. et al.

[11] 4,433,726

[45] Feb. 28, 1984

[54] ENERGIZED PACKER ANCHOR SEAL ASSEMBLY

[75] Inventors: Dan C. Preston, Jr., Whittier; Yung J. Kim, Hacienda Heights, both of Calif.

[73] Assignee: Baker Oil Tools, Inc., Orange, Calif.

[21] Appl. No.: 349,783

[22] Filed: Feb. 18, 1982

[51] Int. Cl.[3] ..... E21B 33/12

[52] U.S. Cl. ..... 166/118; 166/134

[58] Field of Search ..... 166/118, 132, 134, 123; 277/125, 117, 9.5; 285/248, 351, 139

[56] References Cited

U.S. PATENT DOCUMENTS

| | | | |
|---|---|---|---|
| 2,972,381 | 2/1961 | Raulins | 166/125 |
| 3,229,767 | 1/1966 | Carter | 166/134 |
| 3,338,308 | 8/1967 | Elliston et al. | 166/134 |
| 3,456,723 | 7/1969 | Current et al. | 166/134 |
| 3,749,166 | 7/1973 | Young | 166/134 X |
| 4,051,894 | 10/1977 | Goad | 166/73 |

OTHER PUBLICATIONS

Baker Model "D" Drillable Thermoseal Packer Product No. 417-02 & accessories—Model J Latching Type Thermoseal Assembly, Product No. 443-52 (unpublished).

*Primary Examiner*—Ernest R. Purser
*Assistant Examiner*—Thuy M. Bui
*Attorney, Agent, or Firm*—Norvell & Associates

[57] ABSTRACT

A packer adapted for thermal applications to provide sealing integrity between the tubing and casing in a subterranean well is disclosed in combination with a tubing anchor seal assembly for providing secured sealing integrity between the tubing and the seal bore of the packer. The tubing anchor seal assembly comprises an inner mandrel attached to the tubing string. Annular seals are disposed on the exterior of the mandrel. A latch prevents upward movement of the tubing anchor seal assembly relative to the packer, while downward movement is prevented by abutting shoulders. A concentric sleeve engages the seals and radial protrusions on the mandrel transmit longitudinal force to the seals trapped against the sleeve to energize the seals which need not be elastomeric.

11 Claims, 6 Drawing Figures

ENERGIZED PACKER ANCHOR SEAL ASSEMBLY

BACKGROUND OF THE INVENTION

1. Field of the Invention

This invention relates to a seal and anchoring assembly which can be utilized to establish sealing integrity between a tubing string and the bore of a conventional packer in a subterranean oil or gas well.

2. Description of the Prior Art

When conventional packers are utilized in subterranean oil and gas well completions for such purposes as providing a seal between separate producing formations, it is necessary that sealing integrity be established between the inner bore of the packer and the tubing string inserted into the packer. In many applications it is also necessary to secure the tubing string to the packer. This function has generally been performed by use of a conventional anchor seal assembly which utilizes elastomeric sealing elements to establish sealing integrity along the bore of the packer and radially expandable latching collets for engaging the threads which are normally used to set the packer. U.S. Pat. No. 3,229,767 discloses a conventional packer with which conventional anchor seal assemblies can be used. Anchor tubing seal assemblies which can be utilized with the packer disclosed in U.S. Pat. No. 3,229,767 are depicted on page 674 of the 1980–81 Composite Catalog of Oil Field Equipment & Services published by World Oil. These conventional tubing anchor seal assemblies employ elastomeric materials such as nitrile seals or viton seals. These conventional seals can be bonded in place or can comprise a stack of similar sealing elements having a chevron configuration. These conventional tubing seal assemblies also rely upon the inherent resiliency of the sealing elements to provide sealing integrity between the mandrel and the packer bore.

In some applications, for example, where the temperature and pressure are sufficient to cause failure or deterioration of conventional seals, the resiliency in available sealing elements may not be sufficient to establish sealing integrity. One means of establishing this resiliency is to incorporate a spring member into the anchor seal assembly to urge the non-resilient sealing elements into engagement with the packer bore. One example of the use of such spring means is found in U.S. patent application Ser. No. 273,514 filed on June 15, 1981. Of course the need to provide additional spring loading means requires a more complicated structure than is available in conventional anchor seal assemblies. Since the tubing string would generally be subject to unbalanced forces and would be urged in an upward or downward direction it would be desirable to utilize these forces to energize the seal. It would also be desirable to utilize an anchor seal assembly in which the seals are energized due to longitudinal compression regardless of the direction of the force acting on the tubing.

SUMMARY OF THE INVENTION

A tubing anchor seal assembly for securing the tubing in sealed engagement with the internal bore of a packer or similar downhole tool is disclosed and claimed. Annular sealing elements which need not be elastomeric are disposed around a mandrel which is attachable to the tubing string. A latch, such as a collet, is also disposed around the mandrel is engagable with the internal setting threads found on the top conventional packers, to prevent upward movement. A concentric sleeve extends between the seals and the latch. A no-go shoulder located below the seal is engageable with a cooperable shoulder below the packer seal bore surface. Radial protrusions, such as torque splines and a mandrel collar, extend from the mandrel above and below the seals. After the assembly is secured in the well upward movement of the mandrel causes the seals to be longitudinally compressed between the mandrel collar and the sleeve which abuts the lower surface of the latch. Downward movement of the mandrel is transmitted through the splines to the abutting sleeve, thus compressing the seals between the sleeve and the lower shoulder abutting the packer body. This longitudinal compression energizes the seals regardless of the direction in which the mandrel moves and can permit the use of non-elastomeric seals or seals which may have deteriorated over time.

DESCRIPTION OF THE PREFERRED EMBODIMENTS

Figure 1:
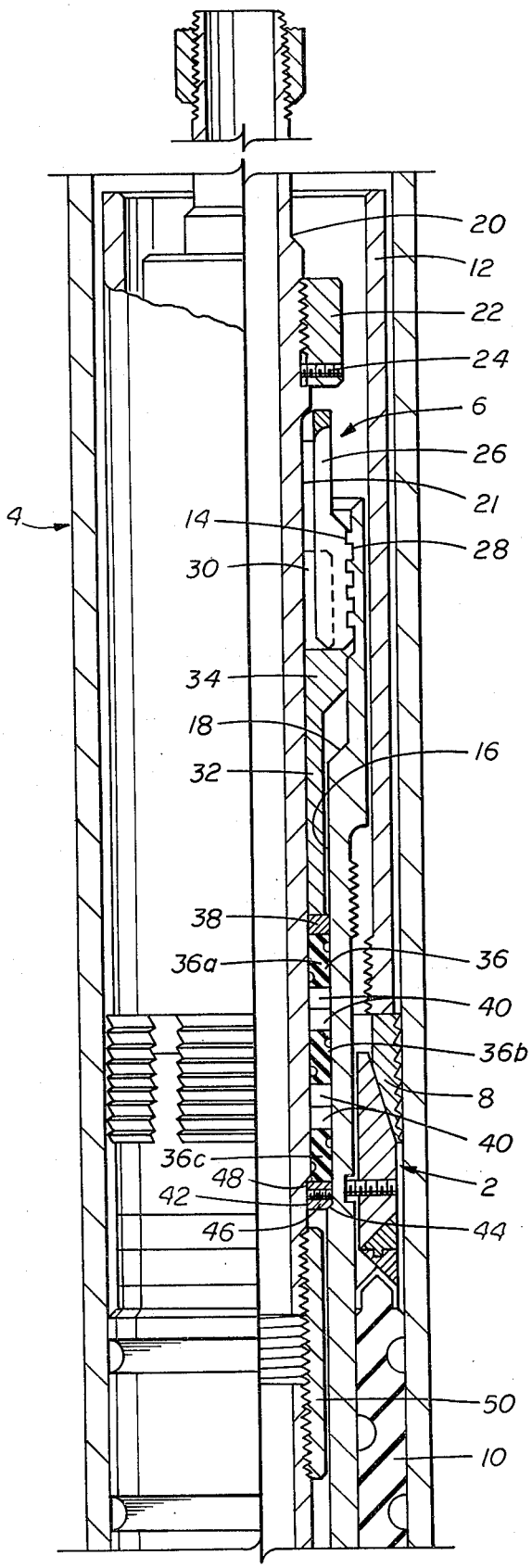
FIG. 1 shows the insertion of a tubing anchor seal assembly into a conventional packer anchored against the casing of a subterranean well.
Figure 1A:
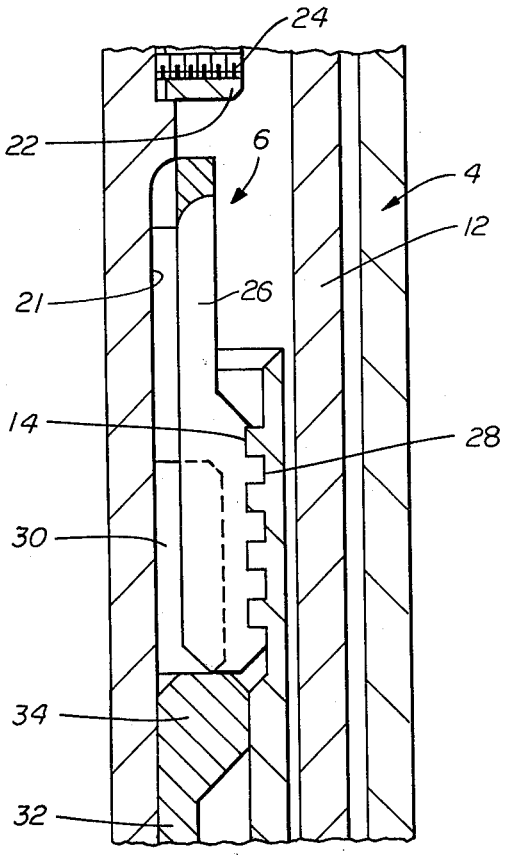
FIGS. 1A and 1B are enlarged views of significant components of the assembly when a downward resultant force acts on the tubing.
Figure 1B:
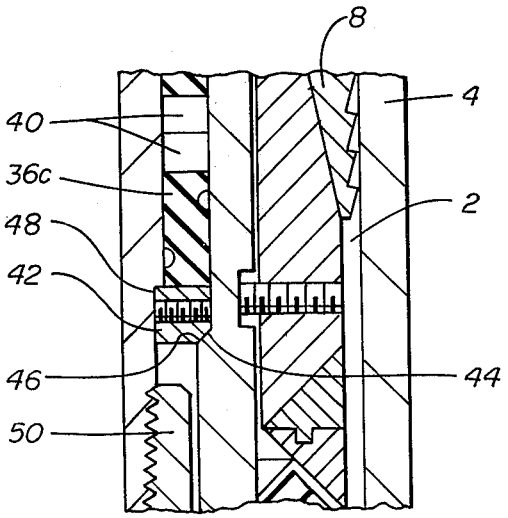

Packer 2 shown mounted in the outer casing 4 of a subterranean oil or gas well comprises a conventional packer which can be used with a tubing string to isolate various zones or subterranean formations. The specific embodiment of the packer shown herein is specifically adapted for use in thermal applications. Anchor seal assembly 6 can be attached to the tubing and permits the establishment of sealing integrity between the tubing and the internal bore of the packer when the tubing is subsequently inserted into a packer which has been previously anchored by expansion of the slips 8 and the packing element 10. The conventional packer shown herein is anchored by applying up-strain on the packer threads 14 located adjacent the top of the body of packer 2 and by simultaneous downward force acting upon the outer setting sleeve 12 extending upward from the body of the packer.

After the packer has been set, the tubing string can be inserted through the bore of the packer. However, some means must be provided for establishing sealing integrity with the packer seal bore 16. Conventionally an anchor seal assembly having an elastomeric sealing element for providing sealing integrity along the packer bore is incorporated in the tubing string. Conventional packer anchor seal assemblies, however, rely upon the inherent resiliency of the sealing elements to provide between the tubing and the packer seal bore. The anchor seal assembly depicted herein is an energized assembly which does not rely solely upon the resiliency of the seal elements to provide sealing integrity between the tubing and the packer bore.

The anchor seal assembly 6 shown herein comprises a mandrel 20 attached at its upper end through a conventional threaded connection to the tubing string (not shown). The anchor seal assembly is attached to the tubing string at the surface of the well and when the tubing string is inserted, it will extend from the packer to the surface of the well. Intermediate the ends of mandrel 20 is an annular collar 22 attached to the mandrel by means of conventional threads and a set screw 24. A radially expandable latch collet 26 extends downwardly from collar 22 and has external latching threads 28 which are cooperable with the internal threads 14 at the top of the packer body. A recess 21 extends around the mandrel on the interior of the latching collet permitting inward deflection of latch collet 26 during insertion of the anchor seal assembly into the packer bore. This latch collet 26 can then ratchet downwardly through packer threads 14 and expansion of latch 26 secures the mandrel and the tubing string to the packer against upward movement. A plurality of splines 30 extend upwardly from the mandrel 20 between adjacent latch fingers. These torque splines are adapted to impart rotary movement to the latch collet to disengage the latch threads 28 from packer threads 14 for removal of the tubing.

A cylindrical sleeve 32 extends downwardly from the secured position of latch collet 26 and concentrically around mandrel 20. Sleeve 32 has an enlarged annular head 34 at its upper end. The upper surface of head 34 is shown in engagement with the lower terminal end of latch collet 26. Sleeve 32 also abuts the lower end of spline 30 in the position shown in FIG. 1 which shows the mandrel 20 adjacent the lower end of its travel.

A plurality of sealing elements 36*a*, 36*b* and 36*c* are located below sleeve 32 and between two metallic seal retainers 38 and 42. These seal elements can comprise resilient packing elements or even elastomeric packing elements, the distinction being that elastomeric elements will return to their original shape even after extreme deformation. With this anchor seal assembly 6, these seal elements 36 could also comprise non-elastomeric or non-resilient sealing elements. For example, thermoplastic sealing elements such as annular members formed of polytetrafluoroethylene, commonly referred to by the Dupont trademark, Teflon, which do not exhibit true elastomeric properties could be used to provide the seal between the mandrel 20 and the packer seal bore surface 16. Non-resilient fibrous sealing elements which could, for example, contain asbestos might also be used. The particular seal system shown in the preferred embodiment of this invention comprises Teflon primary sealing elements and utilizes intermediate back-up rings 40 between adjacent primary sealing elements to compensate for the extrusion of primary sealing elements 36 due to action of temperature and pressure. Upper and lower seal retainers 38 and 42 also provide a back-up against extrusion of the primary sealing elements. The preferred embodiment of the sealing elements shown herein is further described in U.S. patent application Ser. No. 306,458 filed on Sept. 28, 1981. It should be understood, however, that other conventional or non-resilient seal systems could be employed with this invention since the energizing effect of this anchor seal assembly will enhance the sealing action of numerous types of seals. This energizing action can also be effective to insure continued sealing integrity even after conventional elastomeric sealing elements have lost their initial properties due to exposure to the environment in a subterranean well.

Lower seal retainer 42 which comprises an annular metallic member is positioned within a recess 48 located adjacent the lower end of mandrel 20. The upper mandrel should defined by recess 48 limits upward travel of the lower seal retainer 42. Seal retainer 42 has a chamfered shoulder 46 located at its lower outer edge which is cooperable with an upwardly facing shoulder surface 44 located below the packer seal bore surface 16. At the lowermost end of mandrel 20 an outer mandrel collar 50 is attached to the mandrel by means of a conventional threaded connection. In the preferred embodiment shown herein mandrel collar 50 is attached not only to the mandrel but to a portion of tubing or tailpipe extending below the anchor seal assembly 6. In those applications in which additional tubing or tailpipe is not necessary, mandrel collar 50 could comprise a bottom sub attached to the exterior of mandrel 20 or it could comprise a raised annular shoulder on the lower end of the mandrel. The significant factor is that mandrel collar 50 does protrude radially beyond the surface of the mandrel and overlaps the lower portion of seal retainer 42.

Figure 2:
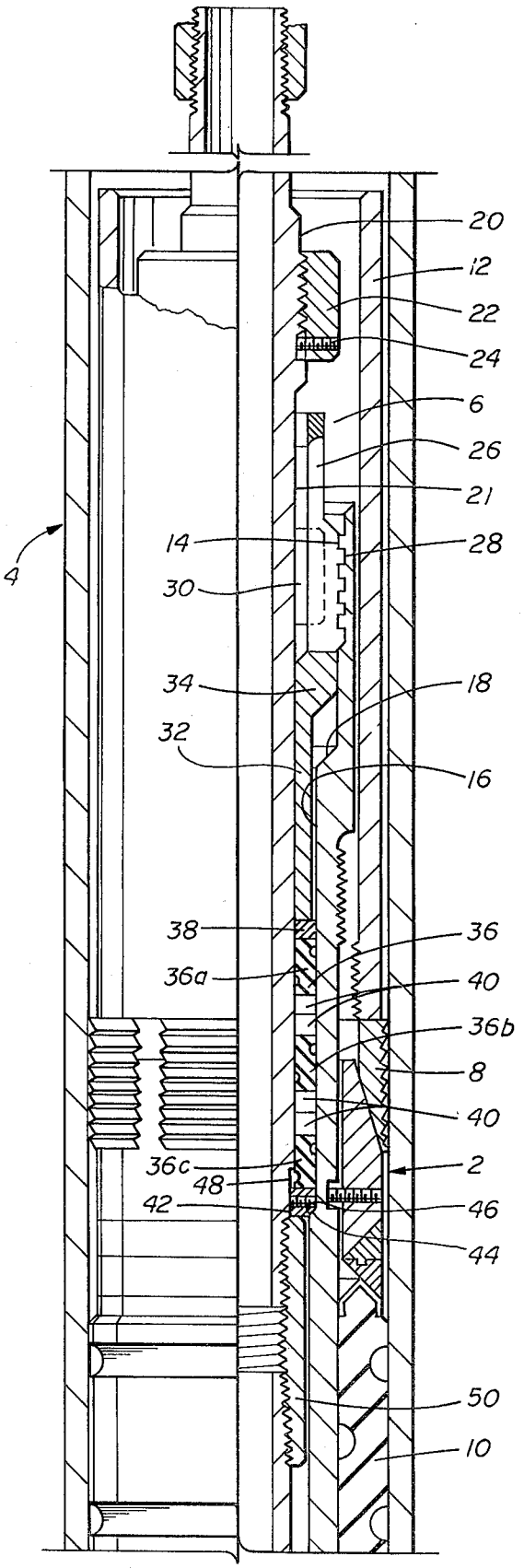
FIG. 2 shows the seal assembly energized by upward movement of the inner mandrel attached to the tubing string.
Figure 2A:
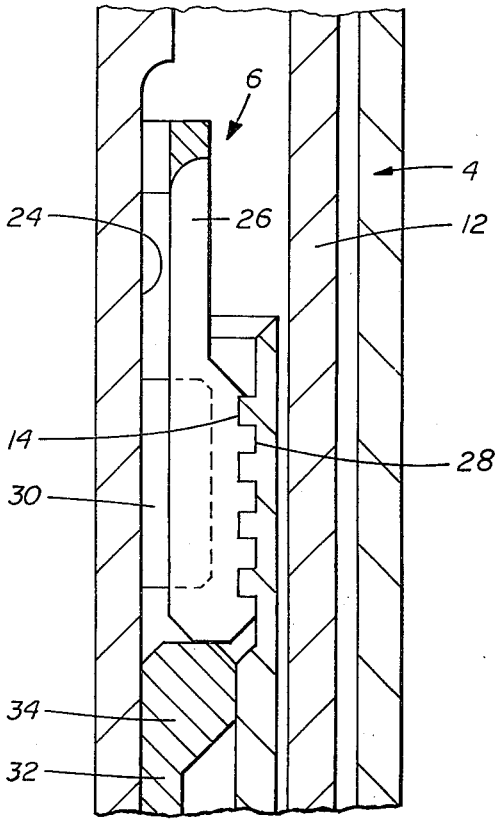
FIGS. 2A and 2B are enlarged views of significant components of the assembly when an upward resultant force acts on the tubing.
Figure 2B:
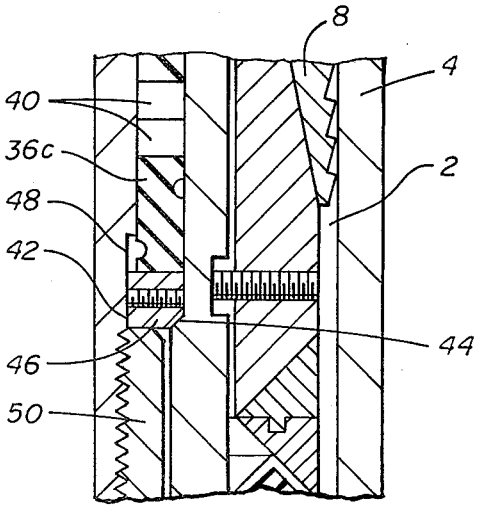

After the anchor seal assembly 6 has been attached to the tubing string by means of the threaded connections on mandrel 20 the anchor seal assembly can be inserted into the bore of the packer. As previously described the latch collet 26 will engage the packer threads 14 to prevent upward movement of the anchor seal assembly. The anchor seal assembly 6 will be properly positioned within the packer bore when shoulder 46 abutts the upwardly facing surface 44 on the inner bore of the packer. Note that the lower surface of the enlarged sleeve head 34 will not abut the upwardly facing inclined surface 18 on the packer prior to abutment of the lower seal retainer with its cooperating packer shoulder. No further significant downward travel of the mandrel is possible since seal retainer 44 is now trapped between oppositely facing shoulders on the mandrel and on the packer. Upward movement of mandrel 20 is possible, however, since there is some travel of mandrel 20 upwardly relative to latch collet 26. Upward movement of mandrel 20 from the position of FIG. 1 to that shown in FIG. 2 will, however, bring the upper shoulder of collar 50 into engagement with the lower end of seal retainer 42. During downward movement, the sleeve abuts the lower surface of splines 30, any tendency of the mandrel 20 to move up will cause an upwardly directed force to be exerted by protruding collar 50 on the lower end of the stack of primary sealing elements 36. Sleeve 32 will, however, resist any upward travel of the stack of primary seals 36 because the lower end of sleeve 32 engages upper seal retainer 38 and in turn engages the seal stack. Sleeve 32 which abuts the bottom of latch collet 26 will thus resist the upward force imparted to the seals through upward movement of collar 50. The seal system will then be trapped in longitudinal compression between sleeve 32 and collar 50. This longitudinal compression will energize the seals and enhance the sealing integrity established between mandrel 20 and packer seal bore surface 16. For thermal applications the pressure below the packer in the tubing will in general be greater than the pressure in the annulus above the packer and the normal tendency will be for these pressures to urge the tubing and mandrel 20 in the upward direction. Thus the inherent forces existing in the well can be utilized to enhance the sealing integrity between the tubing and the packer. Should downward forces be exerted on mandrel 20 through the tubing these forces can be transferred by shoulder means to sleeve head 34. For example, the splines 30 extending outwardly from mandrel 20 engage the upper surface of sleeve head 34. Thus movement of the tubing and mandrel 20 will be transferred through sleeve 32 thus exerting a downward force on the stack of primary seals 36. Seal retainer 42, however, will still engage the upwardly facing no-go shoulder 44 on the packer and again the seals will be trapped in longitudinal compression to energize the seals.

Although the invention has been described in terms of the specified embodiment which is set forth in detail, it should be understood that this is by illustration only and that the invention is not necessarily limited thereto, since alternative embodiments and operating techniques will become appraent to those skilled in the art in view of the disclosure. Accordingly, modifications are contemplated which can be made without departing from the spirit of the described invention.

What is claimed and desired to be secured by Letters Patent is:

1. A tubing anchor seal assembly for use in inserting a tubing string into secured sealing engagement in the bore of a cylindrical tool anchored in a subterranean well comprising: a mandrel having means for incorporating said assembly in said tubing string; a radially expandable latch engageable with said tool and having means for securing said anchor seal assembly in a first position against upward movement; shoulder means extending radially outward from said mandrel for abutting a surface on said tool in a second position to prevent further downward movement of said anchor seal assembly, said mandrel being longitudinally shiftable relative to said latch between said first and second positions, when said latch is engaged; an annular sealing means disposed around said mandrel and longitudinally shiftable relative thereto for establishing sealing integrity between said mandrel and the inner bore of said cylindrical tool and located between said latch and said shoulder means; concentric means on the exterior of said mandrel extending between said seal means and said latch and abutting said latch upon upward movement of said mandrel; and protruding means on said mandrel above and below said seal means; whereby upon upward movement of said mandrel said seal means are longitudinally compressed between the lower protruding means and said concentric means abutting said latch, and upon downward movement of said mandrel, the upper protruding means engages said concentric means to longitudinally compress said seal means, so that said seal means are energized by movement of said mandrel in either direction.

2. The tubing anchor seal assembly of claim 1 wherein said concentric means comprises axially extending sleeve means.

3. A tubing anchor seal assembly for use in positioning a tubing string relative to a packer and securing the tubing string in sealing engagement with the internal bore of said packer located in a subterranean well, the assembly comprising: a mandrel having means for incorporating said assembly in said tubing string; an annular sealing means disposed around said mandrel for establishing sealing integrity between said mandrel and the inner bore of said packer; a radially expandable latch further comprising a collet engagable with internal threads on said packer to secure said tubing anchor seal assembly against upward movement relative to said packer; radially extending splines extending between outwardly expanding latch collet hinges; a seal retainer below said seal means having shoulder means extending between said mandrel and said packer internal bore for preventing further downward movement of said tubing anchor seal assembly relative to said packer; a sleeve abutting the upper end of said seal means and the lower end of said latch upon engagement of said latch with said packer; and a lower protruding means on said mandrel for abutting the lower end of said seal retainer to longitudinally compress and energize said seal means upon upward movement of said mandrel whereby upward forces on said tubing string are transferred to provide sealing integrity between said tubing string and said packer.

4. The tubing anchor seal assembly of claim 3 wherein the upper surface of said sleeve abuts the lower surface of said splines.

5. An assembly for sealing a producing formation in a subterranean well from the portion of the well extending thereabove to permit the production of fluids through a tubing string extending to the surface of the well, comprising: a packer having a cylindrical seal bore surface in the packer body and radially expandable anchoring and packing means; an internal threaded connection on said packer body above said seal bore surface; an upwardly facing internal surface on said packer body below said seal bore surface; a tubing anchor seal assembly for securing said tubing in sealing engagement with said seal bore surface, said tubing anchor seal assembly further comprising; a mandrel having means for engaging the tubing string; annular sealing means disposed around said mandrel for establishing sealing integrity between said mandrel and said packer seal bore surface; a radially expandable latch having threaded means for engaging, in a first position, said packer internal threaded connection to secure said tubing anchor seal assembly against upward movement relative to said packer; a downwardly facing shoulder extending radially beyond said mandrel and engagable in a second position with said packer upwardly facing internal surface to prevent further downward travel of said tubing anchor seal assembly, said mandrel being longitudinally shiftable relative to said latch between said first and second positions, when said latch is engaged; a sleeve abutting the upper end of said seal means and the lower end of said engaged latch; and protruding means above and below said seal means for transmitting axial force to said seal upon respective downward and upward movement of said mandrel to longitudinally compress and energize said seal means.

6. The assembly of claim 5 wherein said sealing means comprise non-elastomeric sealing means.

7. The assembly of claim 5 wherein said radially expandable latch comprises a collet.

8. The assembly of claim 7 wherein said protruding means above said seal means comprises radially extending splines between fingers of said collet.

9. The assembly of claim 8 wherein said latch has a limited axial travel relative to said mandrel.

10. The assembly of claim 9 wherein the upper surface of said sleeve abuts the lower surface of said splines upon downward movement of said mandrel.

11. The assembly of claim 10 wherein the upper surface of said sleeve abuts the lower surface of said latch upon upward movement of said mandrel.

* * * * *